US006634908B1

(12) United States Patent
Billman et al.

(10) Patent No.: US 6,634,908 B1
(45) Date of Patent: Oct. 21, 2003

(54) HIGH DENSITY ELECTRICAL CONNECTOR WITH IMPROVED GROUNDING BUS

(75) Inventors: Timothy B. Billman, Dover, PA (US); Iosif R. Korsunsky, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/161,471

(22) Filed: May 30, 2002

(51) Int. Cl.[7] ..... H01R 13/648
(52) U.S. Cl. ..... 439/608; 439/108
(58) Field of Search ..... 439/608, 108, 439/101, 76.1, 701, 79

(56) References Cited

U.S. PATENT DOCUMENTS 5,980,321 A * 11/1999 Cohen et al. ..... 439/108
6,083,047 A * 7/2000 Paagman ..... 439/608
6,168,469 B1 * 1/2001 Lu ..... 439/608
6,171,115 B1 * 1/2001 Mickievicz et al. ..... 439/76.1
6,174,202 B1 * 1/2001 Mitra ..... 439/608
6,220,896 B1 * 4/2001 Bertoncini et al. ..... 439/608
6,267,604 B1 * 7/2001 Mickievicz et al. ..... 439/79
6,293,827 B1 * 9/2001 Stokoe ..... 439/608
6,299,484 B2 * 10/2001 Van Woensel ..... 439/608
6,343,955 B2 * 2/2002 Billman et al. ..... 439/608
6,375,508 B1 * 4/2002 Pickles et al. ..... 439/608
6,390,857 B1 * 5/2002 Pickles et al. ..... 439/701

* cited by examiner

*Primary Examiner*—Gary Paumen
(74) *Attorney, Agent, or Firm*—Wei Te Chung

(57) ABSTRACT

An electrical connector (1) comprises an insulative housing (10) defining a plurality of channels (14), a plurality of printed substrates (30) partially received in the channels, and a spacer (20) assembled with the printed substrates. The spacer includes a plurality of wafers (21) and defines a plurality of tunnels (200) between every two adjacent wafers for partially receiving corresponding printed substrates. Each wafer has a body portion (22), a plurality of terminals (23) for conductively contacting with the printed substrate, and a grounding bus (24) covering on the body portion. Each grounding bus forms a plurality of grounding members (241, 243, 248) locating on opposite sides of the body portion for conductively contacting with grounding traces formed on two adjacent printed substrates inserted into the tunnels associated with the grounding members.

1 Claim, 14 Drawing Sheets

HIGH DENSITY ELECTRICAL CONNECTOR WITH IMPROVED GROUNDING BUS

CROSS-REFERENCE TO RELATED APPLICATION

This application is a co-pending application of U.S. Patent Application entitled "HIGH DENSITY ELECTRICAL CONNECTOR" filed May 22, 2002 with Ser. No. 10/154,318 and invented by the same inventors, assigned to the same assignee and filed on the same date as the present application. The disclosures of the co-pending applications are wholly incorporated herewith by reference.

BACKGROUND OF THE INVENTION

1. Field of the Invention

The present invention rnlates to an electrical connector, and particularly to a high density electrical connector having a plurality of circuit boards for high speed signal transmission.

2. Description of Related Art

With the development of communication and computer technology, high-density electrical connectors with conductive elements in a matrix arrangement are desired to construct a large number of signal transmitting paths between two electronic devices. The high-density electrical connectors are widely used in internal connecting systems of severs, routers and the other like devices requiring high-speed data processing and communication. Such high-density electrical connectors are disclosed in U.S. Pat. Nos. 6,152,747, 6,267,604, 6,171,115, 5,980,321, and 6,299,484. These high-density connectors each generally comprise two mating connector halves, i.e., a plug connector half connecting with a main board and a receptacle connector half connecting with a daughter card and for mating with the plug connector half, thereby establishing an electrical circuitry between the daughter card and the main board. The plug or receptacle connector half of such a high-density connector is called a "back plane connector" in the art, and such term is used hereafter through the disclosures.

Commonly, a backplane connector comprises a plurality of wafers side-by-side arranged; each wafer has a dielectric housing, a plurality of signal terminals and a plurality of grounding terminals staggeredly disposed in the housing. Since the signal and grounding terminals are independently assembled to the housing, the assembling of the connector is laborious and the manufacturing cost thereof is accordingly high. Furthermore, the grounding terminals in one wafer of the connector only engage with grounding traces of a single corresponding printed substrate in the connector; such a design cannot obtain an optimal performance for signal transmission through the connector.

Hence, an improved backplane connector is required to overcome the disadvantages of the prior art devices.

SUMMARY OF THE INVENTION

Accordingly, a first object of the present invention is to provide a backplane connector having an improved grounding bus which can establish a reliable electrical connection with two adjacent printed substrates in the backplane connector.

A second object of the present invention is to provide a backplane connector having a simplified and integrated grounding structure so that the connector can be easily assembled.

To fulfill the above objects, an electrical connector, to be mounted on a mother board, in accordance with the present invention comprises an insulative housing defining a plurality of channels, a plurality of printed substrates partially received in the channels, and a spacer assembled with the printed substrates. The spacer includes a plurality of wafers defining a plurality of tunnels between every two adjacent wafers for partially receiving corresponding printed substrates. Each wafer has a body portion, a plurality of terminals molded with the body portion and conductively contacting with corresponding signal traces formed on the printed substrate, and a grounding bus covering on the body portion. Each grounding bus forms a plurality of grounding tabs for conductively contacting with grounding traces formed on the printed substrate. Each grounding bus forms a plurality of grounding members locating on opposite sides of the body portion for conductively contacting with grounding traces formed on two corresponding printed substrates inserted into two adjacent tunnels associated with the grounding members.

Other objects, advantages and novel features of the invention will become more apparent from the following detailed description when taken in conjunction with the accompanying drawings.

DETAILED DESCRIPTION OF THE INVENTION

Figure 1:
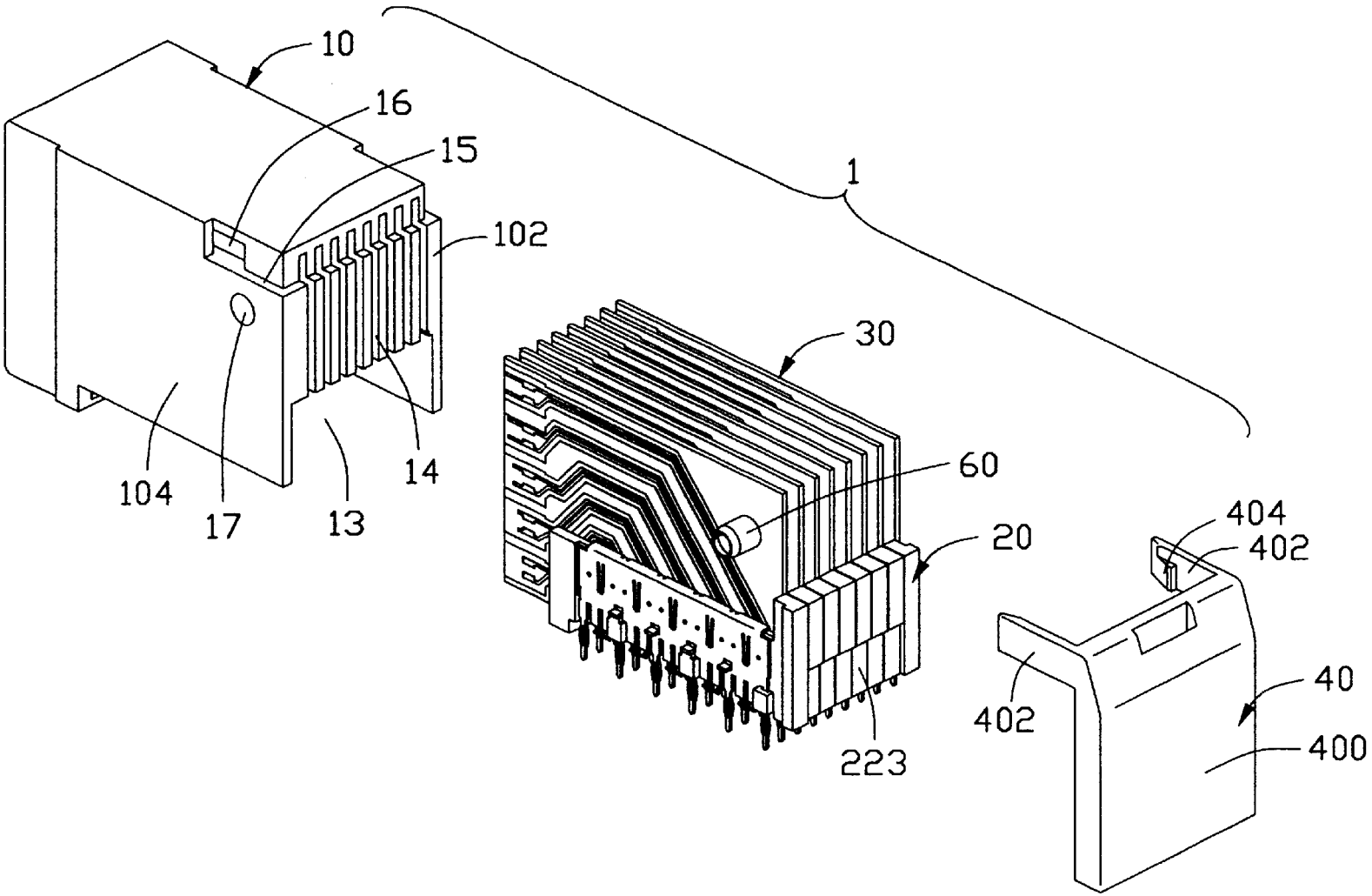
FIG. 1 is an exploded perspective view of a backplane connector in accordance with the present invention.
Figure 2:
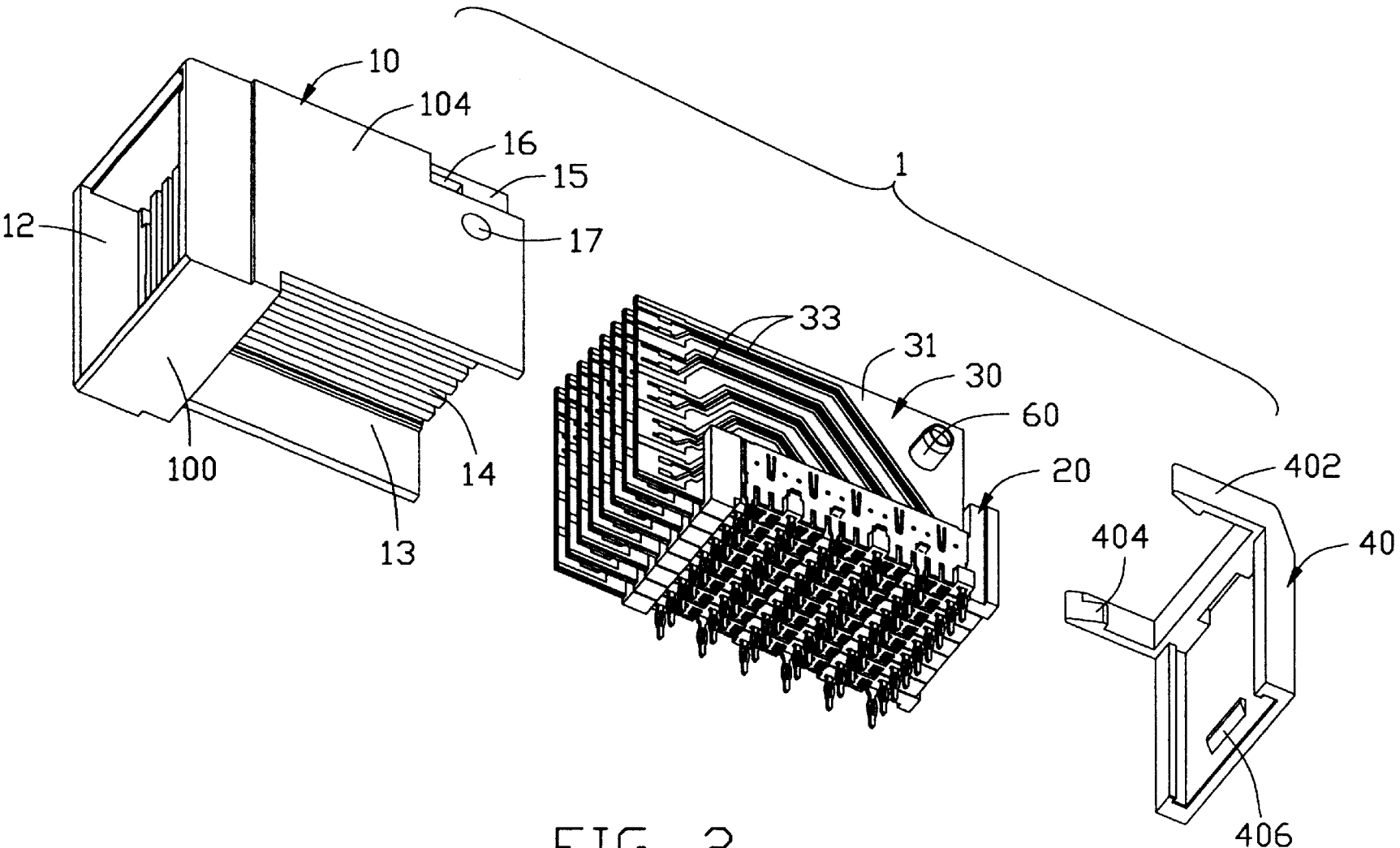
FIG. 2 is another exploded perspective view of the connector of FIG. 1.

Referring to FIGS. 1–2, a backplane connector 1 in accordance with a preferred embodiment of the present invention comprises a dielectric housing 10, a spacer 20, a plurality of printed substrates 30 retained in the spacer 20, and a fastening device 40 securing the spacer 20 combined with the printed substrates 30 to the housing 10. Each printed substrate 30 includes a dielectric base plate 31 made of conventional material for forming a circuit board substrate, such as FR4, and a plurality of conductive signal and grounding traces 33 formed on opposite side surfaces 35, 36 of the printed substrate 30.

The dielectric housing 10 is generally in a rectangular shape and defines a front mating port 12 for partially receiving a complementary connector (not shown). The housing 10 defines an opening 13 extending through a bottom face 100 and a rear face 102 thereof, and a plurality of parallel channels 14 in communication with the opening 13. The channels 14 extend in a longitudinal direction of the housing 10 between the front mating port 12 and the rear face 102. The housing 10 further defines a pair of cutouts 15 adjacent to the rear face 102 in opposite side faces 104 thereof, and a pair of cavities 16 recessed from the cutouts 15. Additionally, a through hole 17 extends in a transverse direction through the opposite side faces 104 of the housing 10.

Figure 3:
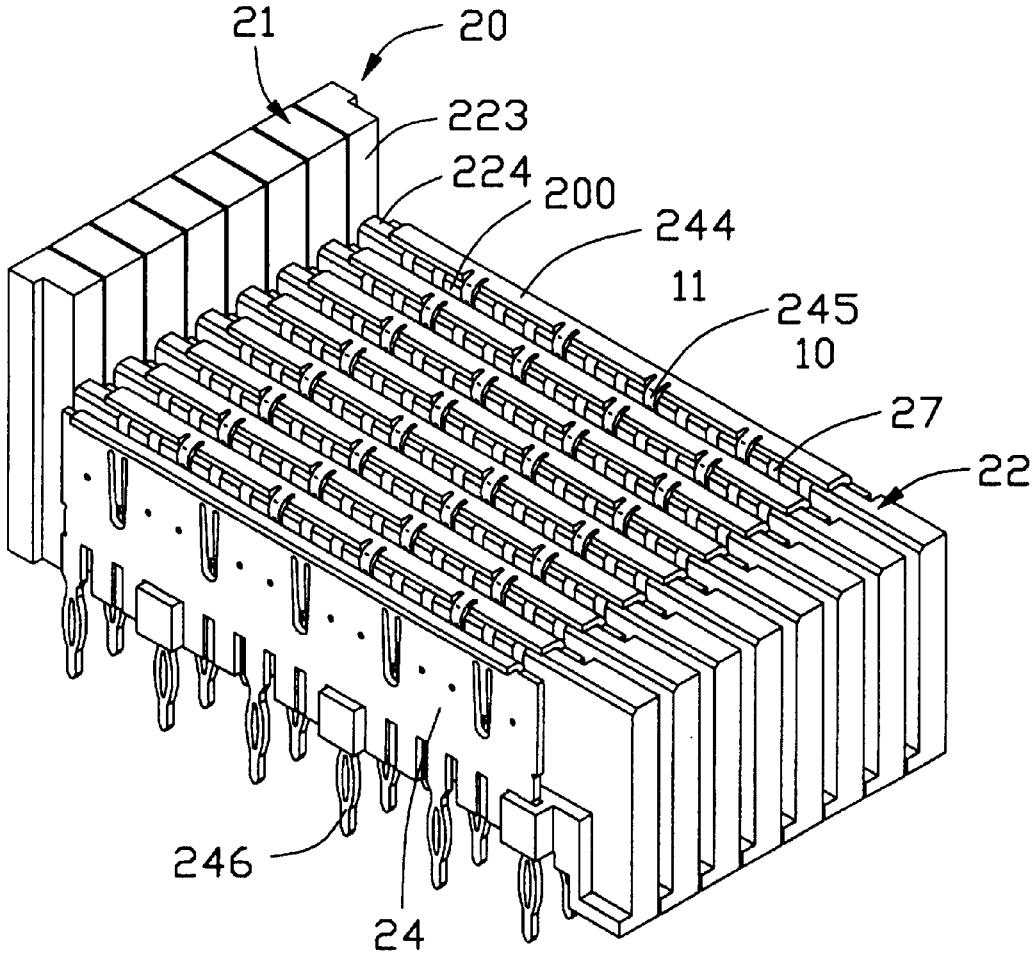
FIG. 3 is an enlarged perspective view of a spacer of the backplane connector of FIG. 1.
Figure 4:
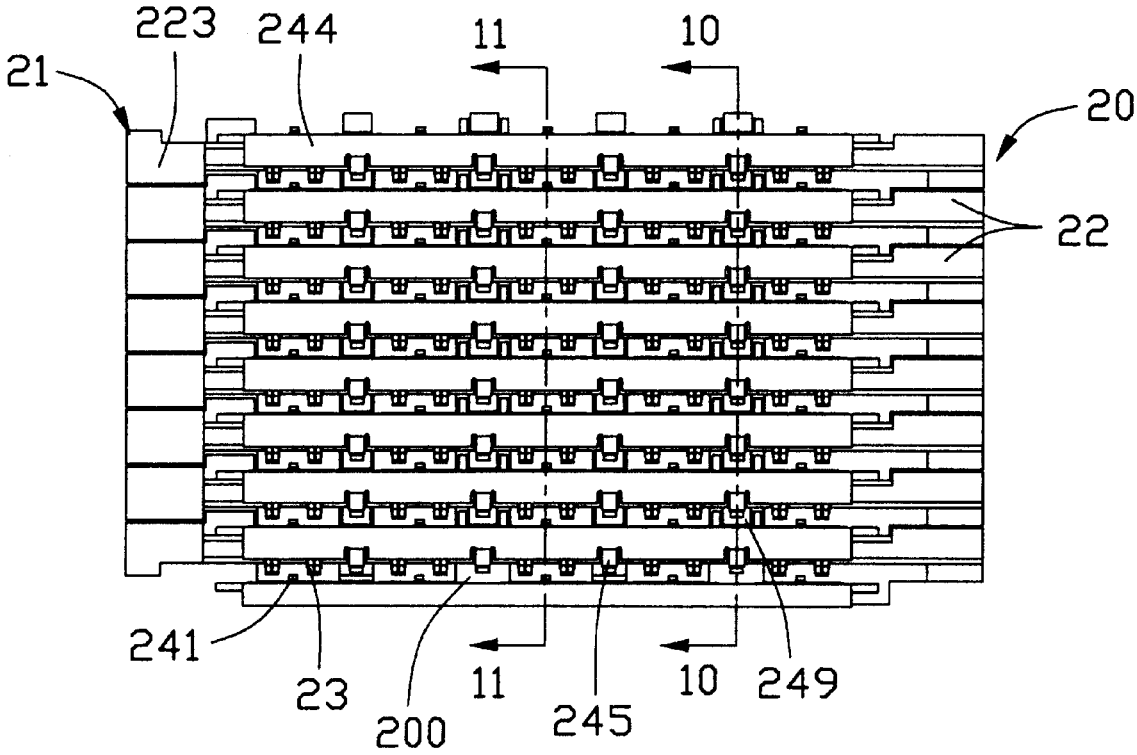
FIG. 4 is a top view of FIG. 3.

Referring to FIG. 3, the spacer 20 consists of a plurality of wafers 21 side by side arranged and defines a plurality of tunnels 200 between every two adjacent wafers 21. Each tunnel 200 has a predetermined width for receiving a corresponding printed substrate (全, 部, 改, 成, 此, 用, 語) 30.

Figure 5:
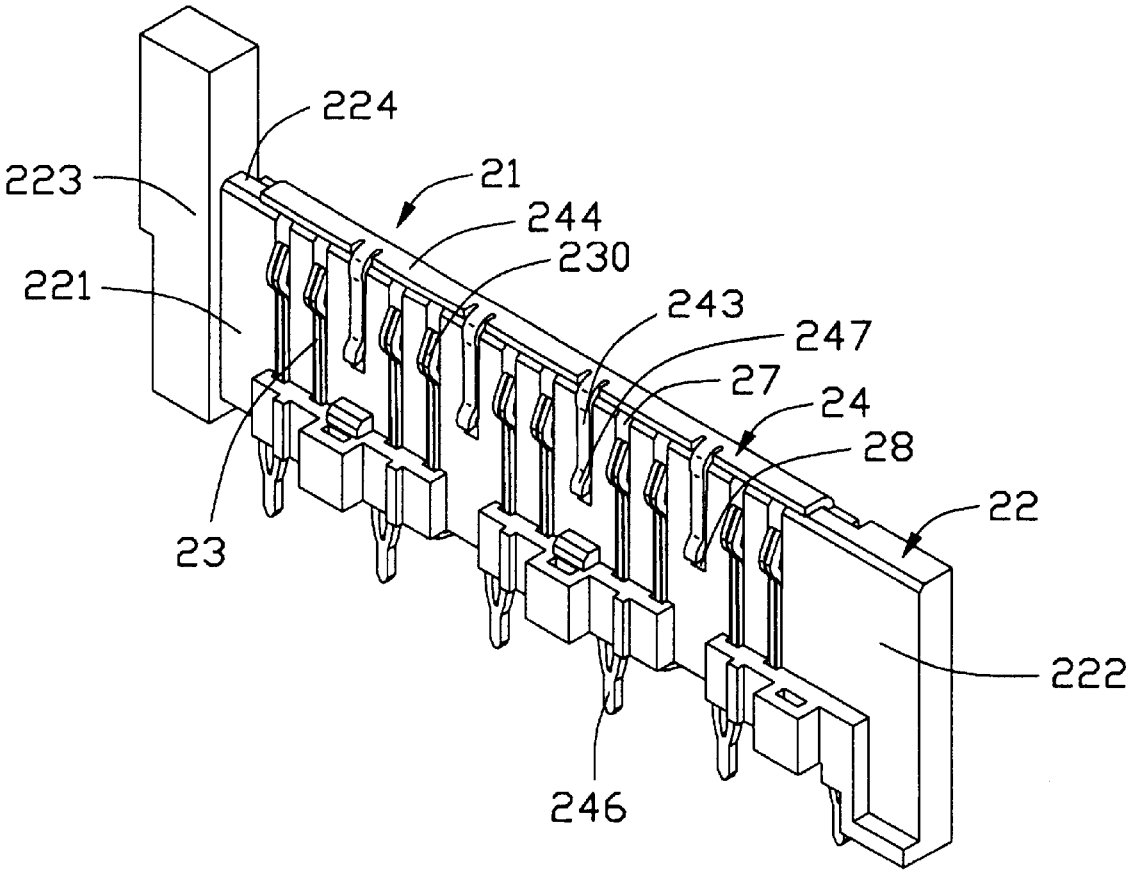
FIG. 5 is a perspective view of a wafer of the spacer of FIG. 3.
Figure 6:
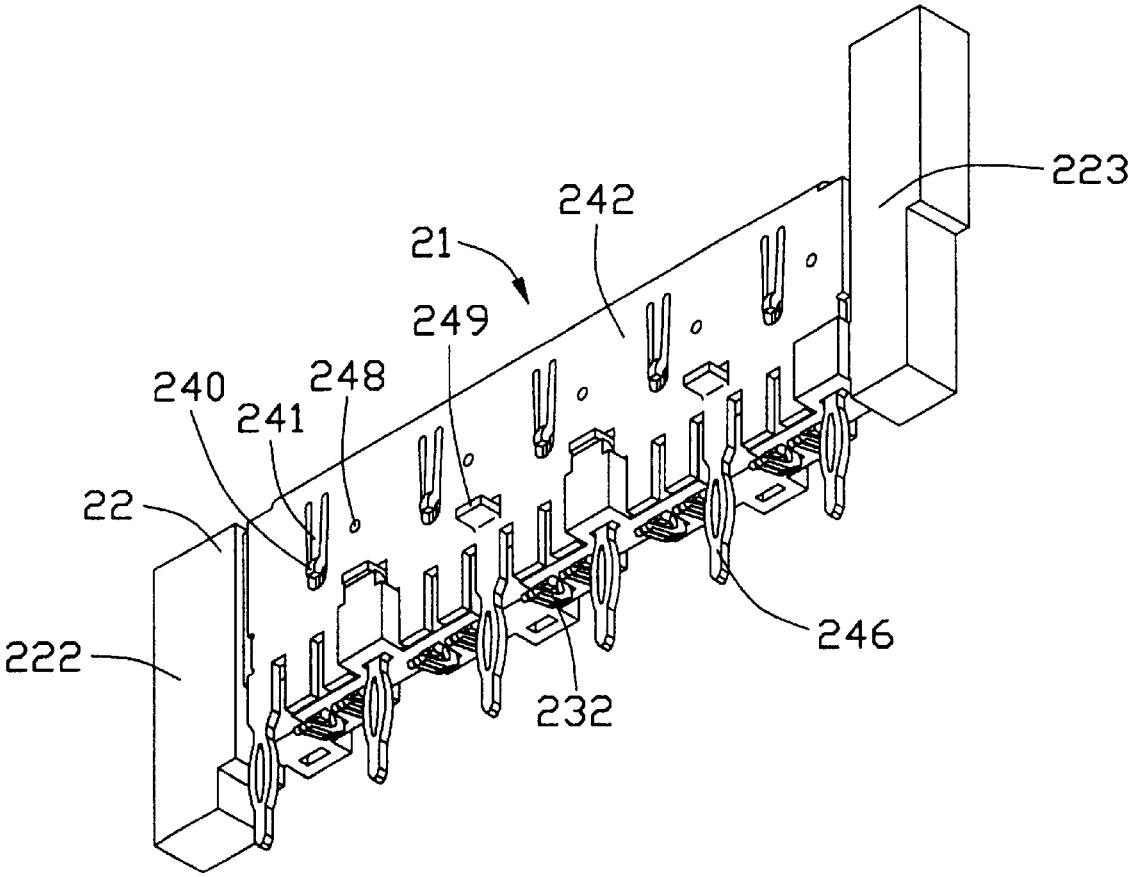
FIG. 6 is another perspective view of the wafer of FIG. 5.

Referring to FIGS. 5 and 6, each wafer 21 includes a body portion 22, a plurality of signal terminals 23 insert molded with the body portion 22, and a grounding bus 24 covering the body portion 22. The body portion 22, made of non-conductive material, such as plastic or the other like material, defines a plurality of passageways 27 and a plurality of slots 28 among the passageways 27 in one side surface 221 thereof. In addition, front and rear end portions 222, 223 extend from opposite ends of the body portion 220 in opposite directions.

Figure 10:
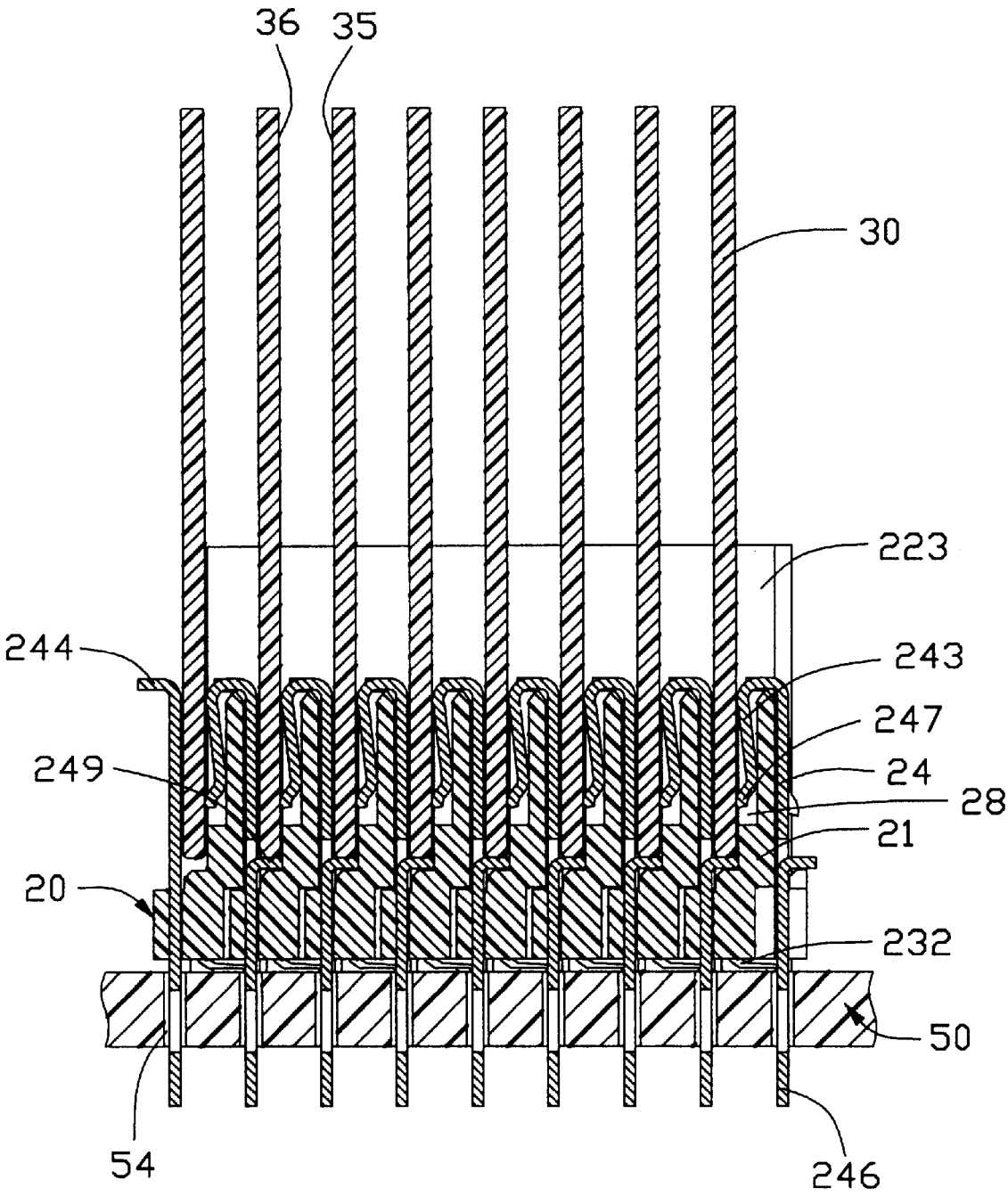
FIG. 10 is an assembled cross-sectional view of the spacer taken along line 10—10 of FIG. 4 with a plurality of printed substrates inserted into the spacer.
Figure 11:
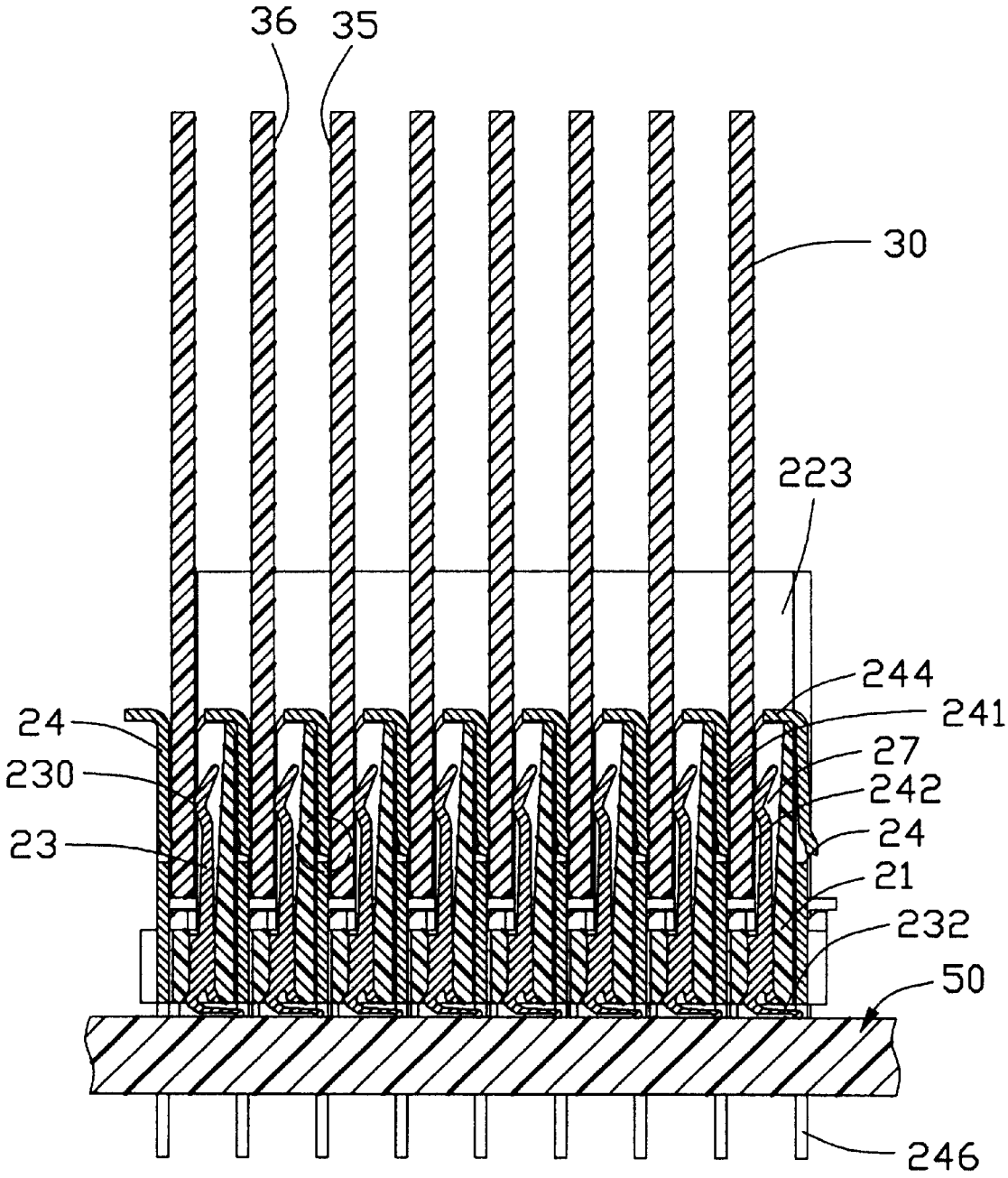
FIG. 11 is a view similar to FIG. 10, taken along line 11—11 of FIG. 4.

Each signal terminal 23 is insert molded in a corresponding passageway 27 of the body portion 22. The signal terminal 23 has a contact portion 230 projecting out of the side surface 221 for conductively contacting with a corresponding signal trace 33 of the 30. As best seen in FIGS. 10 and 11, a solderless mounting tail 232 extends beneath the body portion 22 for conductively contacting a corresponding electronic pad 52 on a main board 50.

Figure 7:
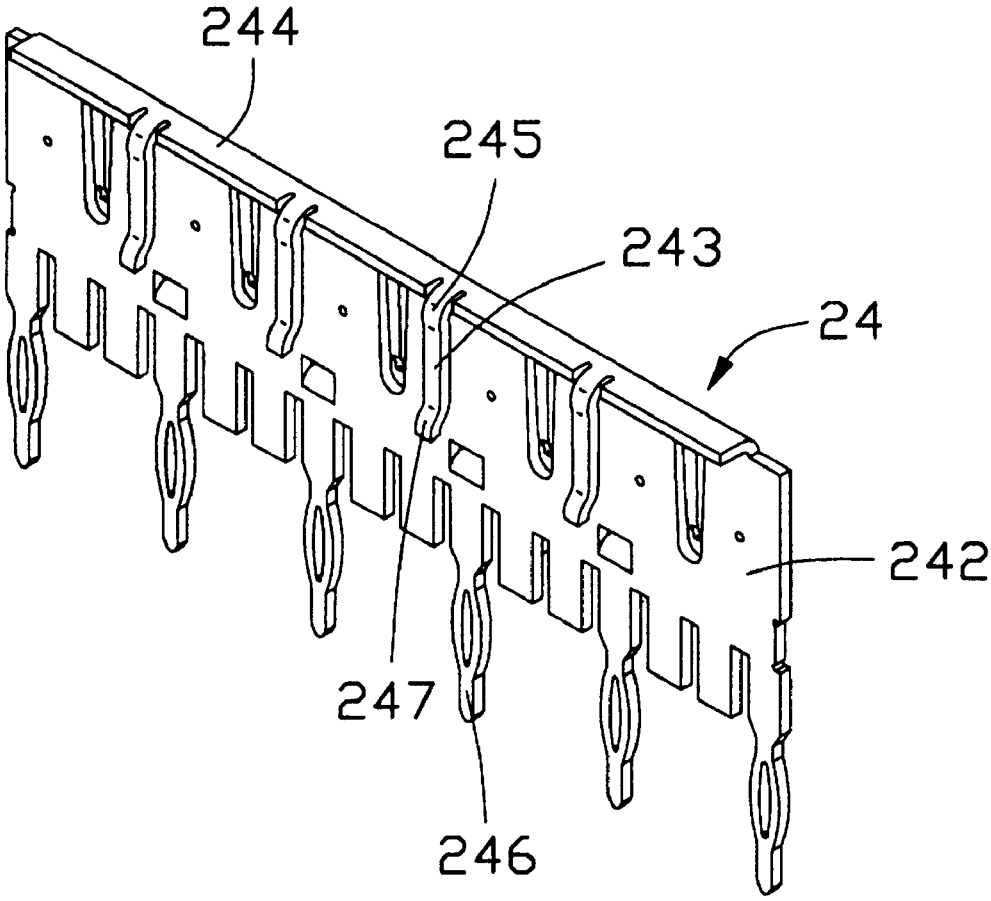
FIG. 7 is a perspective view of a grounding bus of the wafer of FIG. 5.
Figure 8:
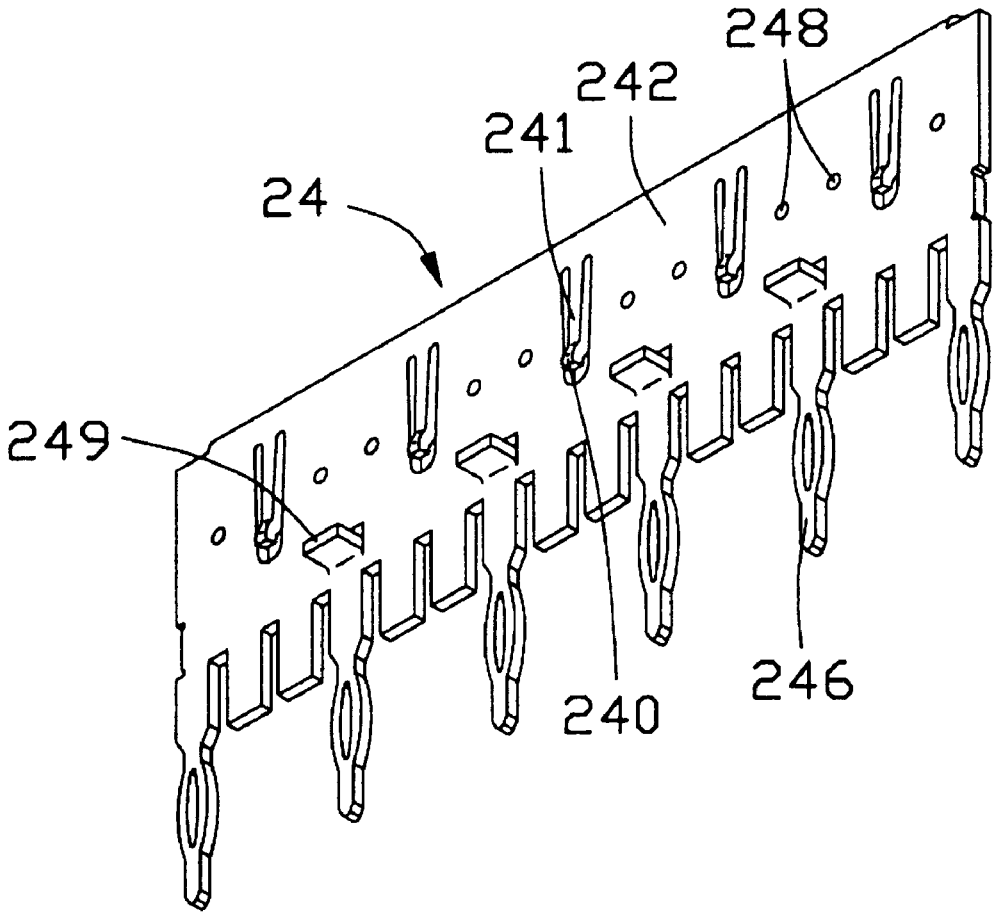
FIG. 8 is another perspective view of the grounding bus of FIG. 7.
Figure 9:
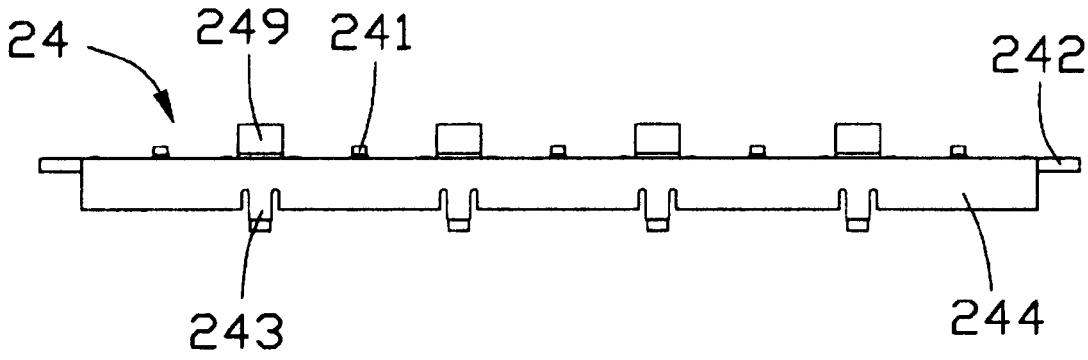
FIG. 9 is a top view of FIG. 7.
Figure 12:
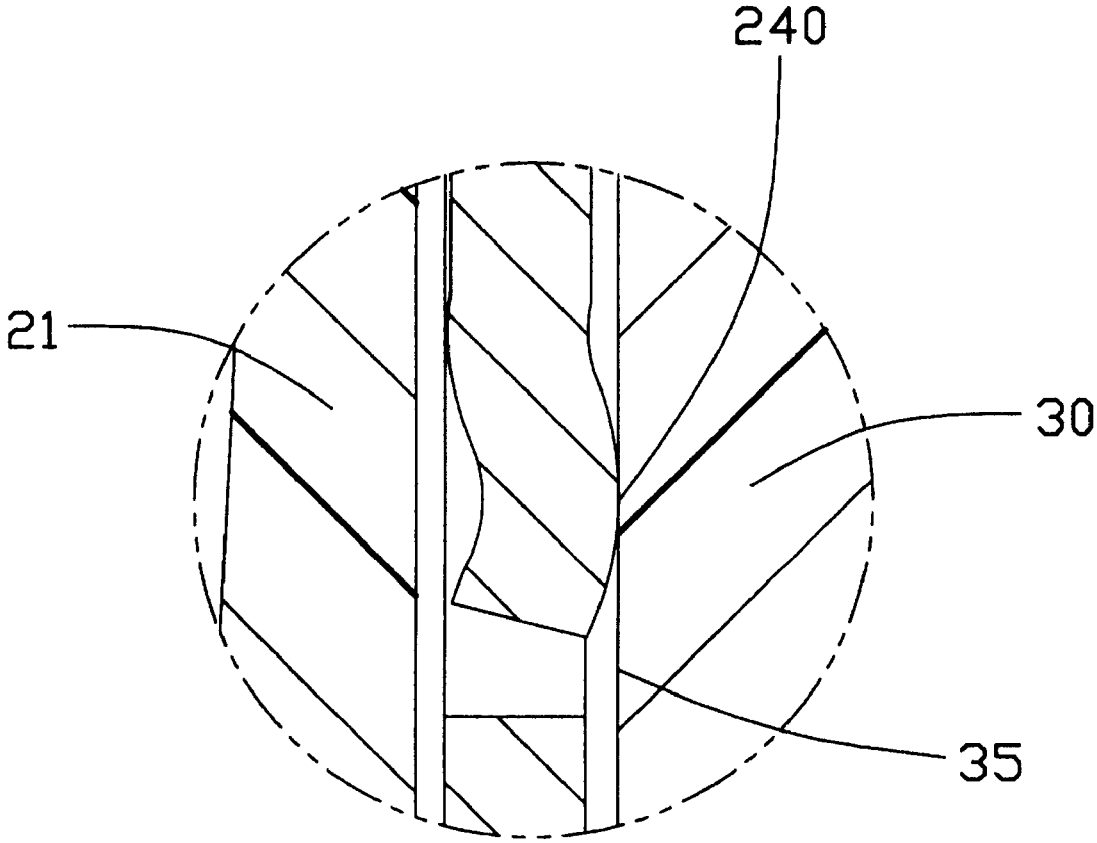
FIG. 12 is an enlarged view of a circled portion of FIG. 11.

Furt her referring to FIGS. 7 to 9, the grounding bus 24 has an elongate body plate 242 covering the other side surface (not labeled) of the body portion 22 opposite to the side surface 221. The elongate body plate 242 forms a row of resilient ribs 241 and each resilient rib 241 has an arc free end 247 projecting in a first direction for conductively contacting a corresponding grounding trace formed on the side surface 35 of a corresponding printed substrate 30. A plurality of dimples 248 are formed on the elongate body plate 242 projecting also in the first direction for engaging with the grounding traces formed on the side surface 35 of the corresponding printed substrate 30 (FIGS. 11 and 12). Additionally, a plurality of stop blocks vertically extend from the body plate 242 in the first direction to stop a lower end of the printed substrate 30, thereby preventing the printed substrate 30 from unduely inserting into the tunnel 200. A flange 244 vertically extends from an upper edge of the body portion 22 and covers on a top surface 224 of the body portion 22. A plurality of press-fit tails 246 depend from a lower edge of the body portion 22 for insertion into corresponding through holes 54 of the mother board 50 (FIG. 10) and each is aligned with a corresponding stop block 249. A plurality of grounding tabs 243 extend downward from a free edge of the flange 244 into a corresponding slot 28 of the body portion 22. Each grounding tab 243 forms a lead-in portion 245 at an upper end thereof and a contact protrusion 247 at a lower end thereof. The lead-in portion 245 has a smoothly arced profile for facilitating insertion of a printed substrate 30 into the corresponding slot 28. The contact protrusion 248 projects out of the side surface 221 of the body portion 22 in a second direction opposite the first direction for conductively contacting a corresponding grounding trace 33 on the side surface 36 of the printed substrate 30 at left of the corresponding printed substrate as viewed from FIG. 10.

Referring back to FIGS. 1 and 2, the fastening device 40 forms a body wall 400 and a pair of latch arms 402 vertically extending from opposite sides of the body wall 400. The body wall 400 forms a bump 406 at an inside thereof for abutting against the rear end portions 223 of the spacer 20. Each latch arm 402 forms a latch projection 404 for latching into a corresponding cavity 16 of the housing 10.

Figure 13:
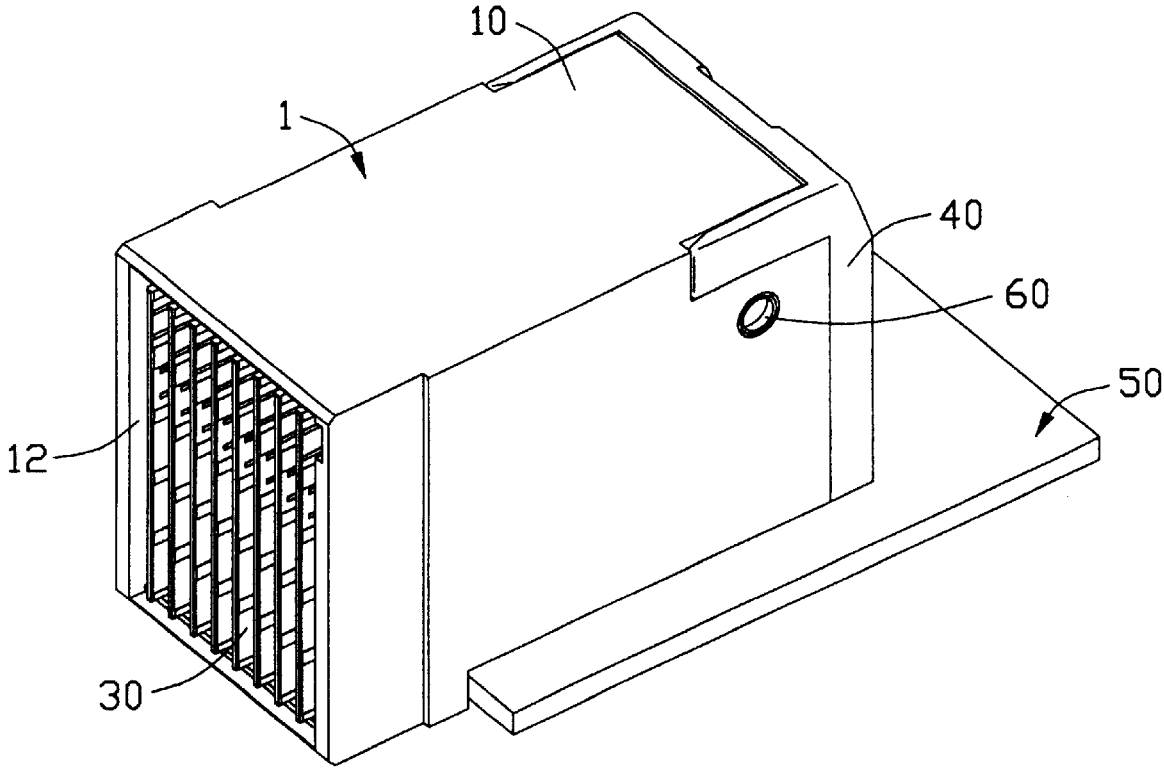
FIG. 13 is an assembled perspective view of the connector of FIG. 1.
Figure 14:
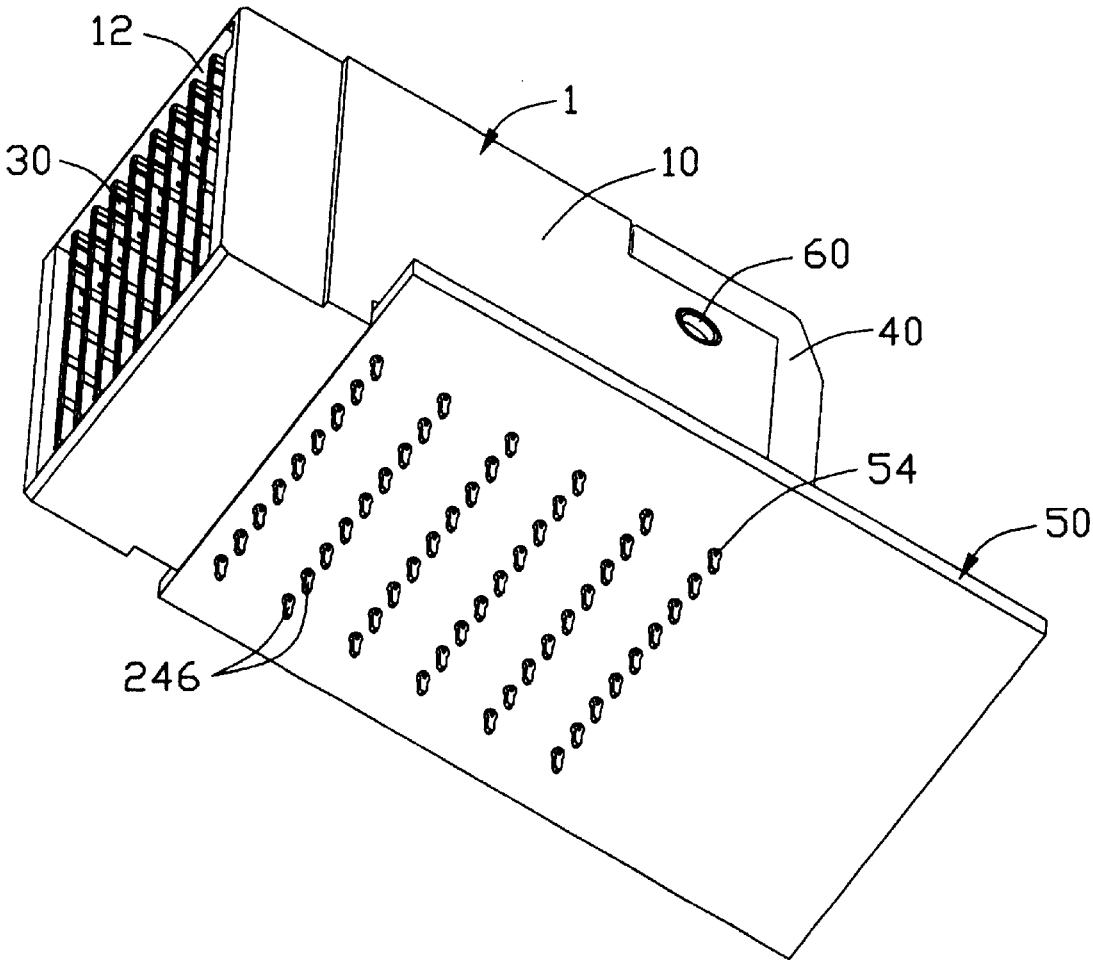
FIG. 14 is an assembled perspective view of the connector of FIG. 2.

In assembly, referring to FIGS. 1–2 and 13–14, the printed substrates 30 fastened by a hinge axel 60, are firstly inserted downwardly into corresponding tunnels 200 of the spacer 20 smoothly and securely from a top of the spacer 20 until the lower ends of the printed substrates 30 are stopped by corresponding stop blocks 249. The contact protrusions 247 of the grounding tabs 243 of a grounding bus 24 and the contact points 240 of the resilient ribs 241 and the dimples 248 of an adjacent grounding bus 24, which project into a common tunnel 200, conductively contact with corresponding grounding traces 33 formed on the opposite side surfaces 35, 36 of the printed substrate 30 inserted into the common tunnel 200. Thus, an improved grounding effectiveness for the printed substrates 30 is obtained to thereby promote the quality of signal transmission through the connector 1. Then, the printed substrates 30 combined with the spacer 20 are horizontally inserted into corresponding channels 14 of the housing 10 from the back of the housing 10. The hinge axel 60 is inserted in the hole 17 of the housing 10 for holding the printed substrates 30 in position. Next, the fastening device 40 is assembled to the back of the housing 10 with the latch arms 402 thereof extending along the cutouts 15 until the latch projections 404 thereof are lathed into corresponding cavities 16 of the housing 20, thereby effectively retaining the spacer 20 and the printed substrates 30 to the housing 10. Finally, electrical connector 1 is mounted onto the main board 50. The mounting tails 232 of the terminals 23 are conductively contacted with corresponding electric pads 52 of the mother board 50. The grounding tails 246 of the grounding buses 24 are press-fitted into corresponding through holes 54 of the mother board 50. Thus, an assembled electrical connector 1 mounted on the mother board 50 is obtained, as shown in FIGS. 13 and 14.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a mother board, comprising:

an insulative housing defining a plurality of channels;

a plurality of printed substrates partially received in the channels; and a spacer including a plurality of wafers and defining a plurality of tunnels between every two adjacent wafers, the printed substrate being also partially received in the tunnels, each wafer having a body portion, a plurality of terminals retained in the body portion and conductively contacting with signal traces formed on a corresponding printed substrate, and a grounding bus covering the body portion and having a plurality of grounding members located on opposite sides of the body portion for conductively contacting with grounding traces formed on the corresponding printed substrate and on a neighboring printed substrates;

wherein the plurality of wafers are side-by-side arranged;

wherein the body portion of each wafer defines in one side surface thereof a plurality of passageways for receiving the terminals and a plurality of slots for receiving corresponding grounding members oaf the grounding bus;

wherein the grounding bus has a body plate covering on another side surface of the body portion of each wafer, a flange vertically extending from an upper edge of the body plate and covering a to face of the body portion of each wafer, and a plurality of grounding tails depending from a lower edge of the body plate for insertion into corresponding through holes of the mother board;

wherein the grounding members include a plurality of grounding tabs depending from the flange and received in corresponding slots of the body portion, a plurality of grounding ribs and a plurality of dimples on the body plate of the grounding bus, both opposite to the grounding tabs;

wherein each of the grounding tabs and grounding ribs forms a contact protrusion conductively contacting a corresponding grounding trace on the printed substrate;

wherein a plurality of stop blocks vertically extend fronm the body plate of the grounding bus for preventing the printed c=substrate from overdue insertion into a corresponding tunnel, each aligned with a corresponding grounding tail;

further comprising a fastening device attached to the housing for retaining the spacer and the printed substrate to the housing;

wherein the fastening device has a body wall and a pair of latch arms extending from the body wall;

wherein each latch arm forms a latch projection, and wherein the housing defines a recessed cavity latching with the latch projection.

* * * * *